US008303380B2

(12) United States Patent
Lehman

(10) Patent No.: US 8,303,380 B2
(45) Date of Patent: Nov. 6, 2012

(54) ABRADING DEVICE HAVING A FRONT EXHAUST

(75) Inventor: Frank Lehman, Wilson, NY (US)

(73) Assignee: Dynabrade, Inc., Clarence, NY (US)

( * ) Notice: Subject to any disclaimer, the term of this patent is extended or adjusted under 35 U.S.C. 154(b) by 341 days.

(21) Appl. No.: 12/693,973

(22) Filed: Jan. 26, 2010

(65) Prior Publication Data

US 2011/0183586 A1 Jul. 28, 2011

(51) Int. Cl.
*B24B 23/00* (2006.01)

(52) U.S. Cl. ..... 451/357; 451/442; 451/449; 451/457

(58) Field of Classification Search ..... 451/294–295, 451/357, 451–457, 442, 449, 487
See application file for complete search history.

(56) References Cited

U.S. PATENT DOCUMENTS

| | | | | |
|---|---|---|---|---|
| 2,077,693 | A * | 4/1937 | Herrero | 451/358 |
| 2,905,149 | A * | 9/1959 | Swanson | 418/270 |
| 3,295,262 | A * | 1/1967 | Brown | 451/344 |
| 4,205,732 | A * | 6/1980 | Auerbach et al. | 181/230 |
| 4,411,106 | A * | 10/1983 | Fleckenstein et al. | 451/355 |
| 4,821,365 | A * | 4/1989 | Charters | 15/339 |
| 4,854,085 | A | 8/1989 | Huber | |
| 4,932,164 | A * | 6/1990 | Sullivan et al. | 451/359 |
| 5,319,888 | A * | 6/1994 | Huber et al. | 451/357 |
| 5,609,516 | A | 3/1997 | Courson et al. | |
| 5,731,556 | A * | 3/1998 | Gardner et al. | 181/230 |
| 5,919,085 | A * | 7/1999 | Izumisawa | 451/357 |
| 5,993,305 | A * | 11/1999 | Chu | 451/357 |
| 6,206,771 | B1 | 3/2001 | Lehman | |
| 6,328,643 | B1 | 12/2001 | Huber | |
| 6,361,424 | B1 | 3/2002 | Manor et al. | |
| 6,855,040 | B2 | 2/2005 | Huber | |
| 7,238,095 | B1 * | 7/2007 | Sun et al. | 451/344 |
| 7,252,580 | B2 * | 8/2007 | Lin | 451/295 |
| 7,997,959 | B2 * | 8/2011 | Hutchins et al. | 451/294 |
| 2008/0160887 | A1 * | 7/2008 | Hutchins | 451/357 |

FOREIGN PATENT DOCUMENTS

| | | |
|---|---|---|
| EP | 0 901 841 A1 | 3/1999 |
| FR | 24 48 418 A1 | 2/1979 |
| FR | 26 88 730 A1 | 9/1993 |
| FR | 27 65 502 A1 | 1/1999 |
| FR | 29 34 189 | 1/2010 |

* cited by examiner

*Primary Examiner* — George Nguyen
(74) *Attorney, Agent, or Firm* — Simpson & Simpson, PLLC

(57) ABSTRACT

A head for an orbital abrading machine comprising a housing, a shroud including inner and outer portions, defining a chamber between the inner and outer portions, a drive means for driving an abrading pad, the drive means at least partially enclosed by the housing and the shroud, wherein the drive means produces an exhaust which is directly vented into the chamber without leaving the head, and wherein the chamber includes at least one opening for directing the exhaust toward the abrading pad for cooling the pad with the exhaust.

10 Claims, 5 Drawing Sheets

ABRADING DEVICE HAVING A FRONT EXHAUST

FIELD OF THE INVENTION

The invention broadly relates to abrading devices, more specifically to pneumatically-powered random orbital devices, and even more particularly to a pneumatically-powered random orbital buffer having a front exhaust.

BACKGROUND OF THE INVENTION

Random orbital buffing devices are well known in the art. They are used to polish and finish various surfaces without the drawbacks inherent to rotary-type buffing devices. For example, a random orbital buffer may be used to polish a coat of paint on a new automobile. Random orbital buffing devices are commonly pneumatically-powered. After being used to power the device, the compressed air or gas must be exhausted from the device. One problem common to pneumatic devices is that the exhausting air may produce a large amount of noise, which is undesirable for the user of the device.

For example, abrading tool 10 is shown in FIGS. 1A and 1B. Tool 10 includes head 12, which houses a drive means for driving abrasive pad 14. The drive means may be, for example, a drive means according to U.S. Pat. No. 6,206,771 (Lehman) or U.S. Pat. No. 4,854,085 (Huber et al.), which patents are incorporated herein by reference. Head 12 is affixed to handle portion 16, which includes trigger mechanism 18 for controlling the operation of tool 10. Port 20 is located at the back of the handle portion for coupling the tool to a pneumatic power source, such as a pressurized air tank. Shroud 22 is included to at least partially contain the drive means. Hang ring 24 may be included to provide a convenient means for storing the device when not in use, such as from a hook.

Many devices incorporate mufflers to reduce the noise produced by the exhausting air. Traditionally, these mufflers increase the overall size of the device. To reduce the negative effects that this extra size has on the device's usability, these mufflers are commonly placed in or attached to the device's handle, since there is no room to accommodate a muffler in the head portion of the tool proximate the drive means. The channel from the coupling port (port 20) for the input air is frequently in the handle for the same reason, leading to a common design where the input and exhaust air lines are coaxial or parallel to each other in the handle of the device. That is, separate input and exhaust channels are both included in the handle.

For example, muffler 26 is included at the rear of tool 10 to muffle the exhaust of the device. This embodiment results in the exhaust air being vented from the rear of the device, near the connector for the input air. This embodiment adds complexity to the device in the form of a second air line that runs the length of the device between the muffler and the outlet of the drive means. Additionally, a constant current of air is exhausted near the user while the device is in use.

An alternative to this embodiment is included in some grinding devices, which involves venting the exhaust air from the front of the device, onto the abrading pad. Directly exhausting the drive means onto the abrading pad advantageously provides cooling of the pad. Additionally, two separate lines or channels are not required in the handle portion, reducing the complexity of the handle. Also, this eliminates the need to include a muffler, which, in addition to the lack of two channels in the handle, enables more design choices in handle shape and size.

However, internal space is very limited in the head of these tools, resulting in front-exhaust tools which do not include mufflers. For grinding operations, muffling the exhaust is not a necessity, due to the inherent loudness of grinding. However, muffling is vital for buffing tools to reduce the noise of the tool. Thus, front-exhausting tools tend to be much louder than rear-exhausting tools. Some embodiments attempt to combine the benefits of the front-exhausting and rear-exhausting embodiments by piping the exhaust air from the muffler at the rear of the handle of the device with an exterior line to carry the exhaust back to the front of the device, where it is exhausted onto the pad. This embodiment adds the extra complexity and size for the exterior exhaust line.

A final problem common to pneumatically-powered buffing devices, and buffing devices generally, is that heat created by the buffing action can damage the surface that is being polished. To prevent the build-up of excess heat, buffing devices are usually limited in speed, or users must operate the devices carefully to ensure particular portions of the surface are not overworked. These limitations reduce the effectiveness of the device, increasing the time needed to polish the surface.

As can be derived from the variety of devices and methods directed at effectively exhausting pneumatically-powered buffing devices, many means have been contemplated to accomplish the desired end, i.e., preventing the exhausting air from interfering with the buffing action of the device. Heretofore, tradeoffs between noise, device design, preservation of the surface to be polished, and user comfort were required. Thus, there is a long-felt need for a pneumatically-powered buffing device that minimizes exhaust noise and accidental damage to the surface to be polished, while preventing the device's exhaust structures from interfering with the timely and efficient operation of the device.

BRIEF SUMMARY OF THE INVENTION

The present invention broadly comprises a head for an orbital abrading machine including a housing, a shroud including inner and outer portions, defining a chamber between the inner and outer portions, a drive means for driving an abrading pad, the drive means at least partially enclosed by the housing and the shroud, wherein the drive means produces an exhaust which is directly vented into the chamber without leaving the head, and wherein the chamber includes at least one opening for directing the exhaust toward the abrading pad for cooling the pad with the exhaust.

In one embodiment, the drive means comprises a pneumatically-powered rotor. In one embodiment, the head further includes an exhaust cavity for receiving the exhaust from the drive means, the exhaust cavity in pneumatic communication with the chamber for enabling the exhaust to flow from the exhaust cavity and into the chamber. In one embodiment, the inner and outer shroud portions are engaged against the housing about an orifice with a first seal and a second seal, respectively, wherein the orifice provides the pneumatic communication between the exhaust cavity and the chamber, for preventing leakage of the exhaust as the exhaust flows from the exhaust cavity through the orifice into the chamber. In one embodiment, the drive means receives a pneumatic input, the pneumatic input sealed from the exhaust except for a path through the drive means. In one embodiment, muffling material is contained within the chamber for muffling the exhaust. In one embodiment, the drive means is secured at least partially within the housing with a lock ring, wherein a spacer is provided with the lock ring for creating a gap, the gap enabling pneumatic communication between the exhaust cavity and the chamber.

The current invention also broadly comprises an abrading tool including a head according to the above; a handle secured to the head, the handle including a port for coupling the abrading tool to a source for powering the drive means. In one embodiment, the abrading tool is pneumatically-powered. In one embodiment, the abrading tool is a random orbital buffer. In one embodiment, the chamber includes muffling material for enabling the shroud to muffle the exhaust.

These and other objects and advantages of the present invention will be readily appreciable from the following description of preferred embodiments of the invention and from the accompanying drawings and claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. It should be appreciated that the term "device" is synonymous with terms such as "tool", "machine", etc., and such terms may be used interchangeably as appearing in the specification and claims. Additionally, the term "buffer," "buffing device," and the like may be used interchangeably. Furthermore, "abrasive pad" or "abrading pad" may be used to refer to any polishing, buffing, abrading, or other pad suitable for such orbital tools. Although any methods, devices or materials similar or equivalent to those described herein can be used in the practice or testing of the invention, the preferred methods, devices, and materials are now described.

Figure 2:
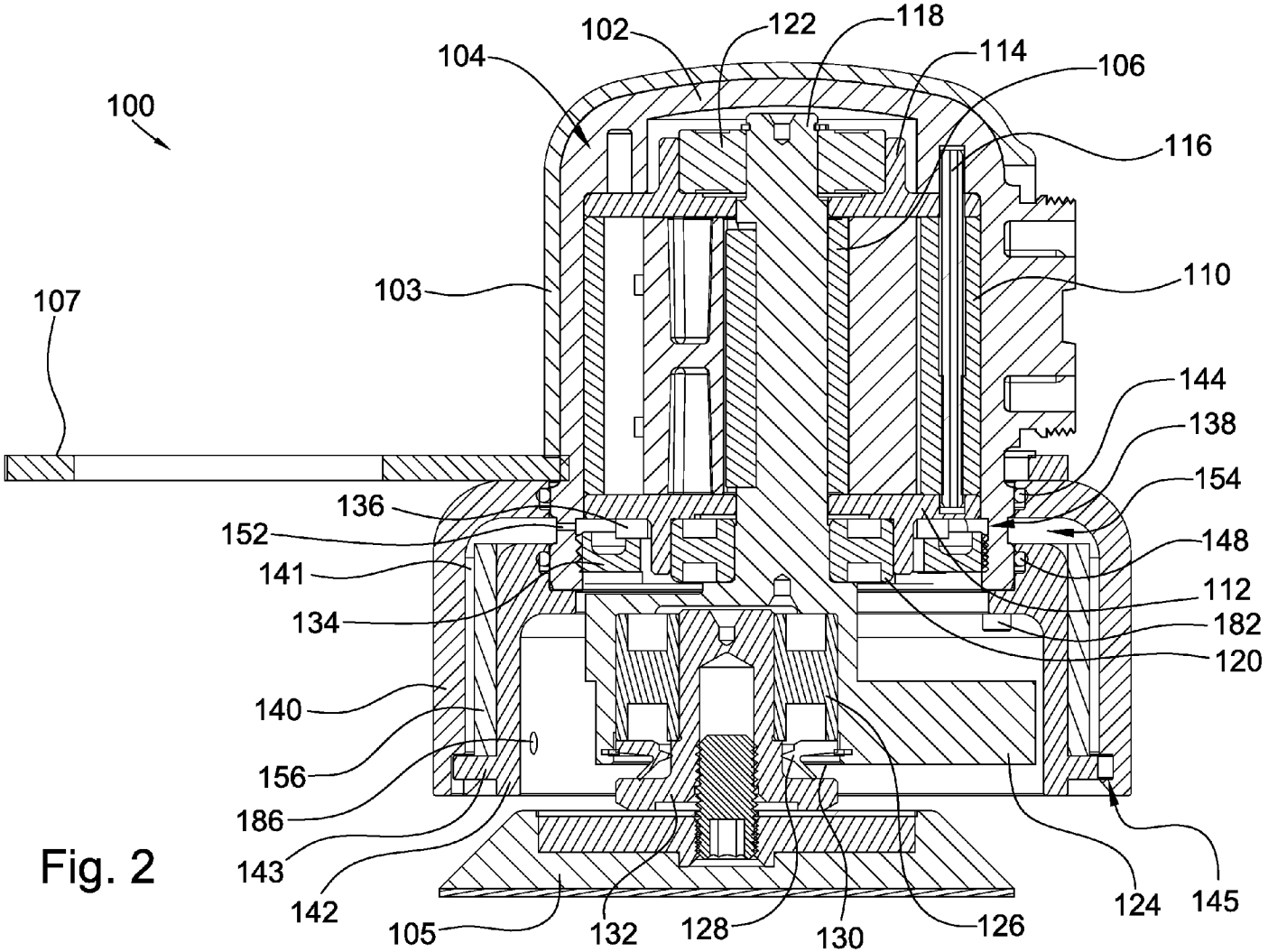
FIG. 2 is a cross-sectional view of a head for an abrading tool according to the current invention.
Figure 3:
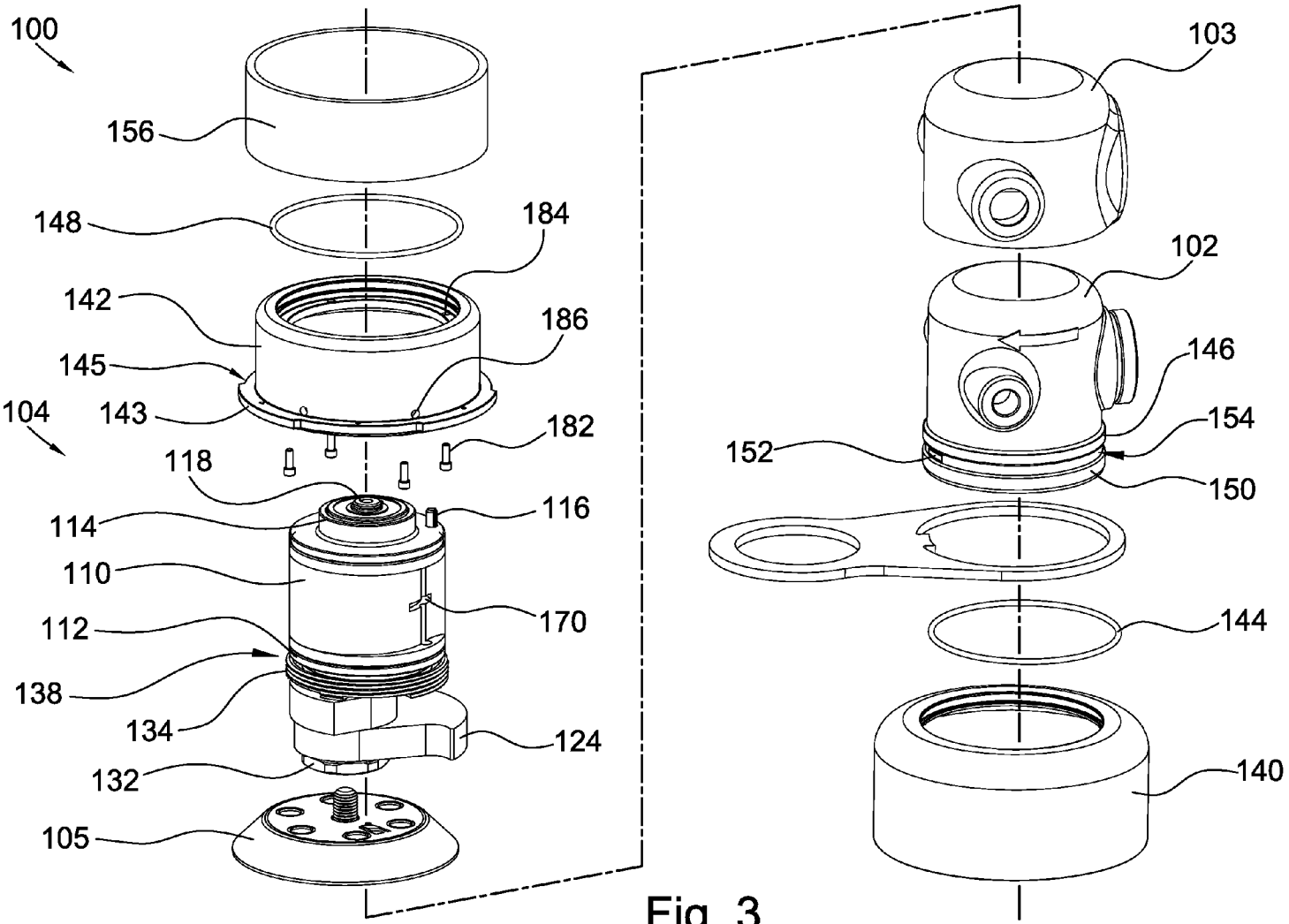
FIG. 3 is an exploded view of the head shown in FIG. 2.

Referring now to the figures, FIGS. 2 and 3 show buffer head 100. Head 100 is generally formed by housing 102, which contains drive assembly 104. Head 100 is arranged to directly vent the exhaust from drive assembly 104 onto abrasive or buffing pad 105. Since head 100 is arranged to be held by a user during an abrading operation, grip cover 103 may be included to provide a more comfortable gripping surface for the user. Head 100 may also include hang ring 107, similar to hang ring 24, discussed above.

Figure 1A:
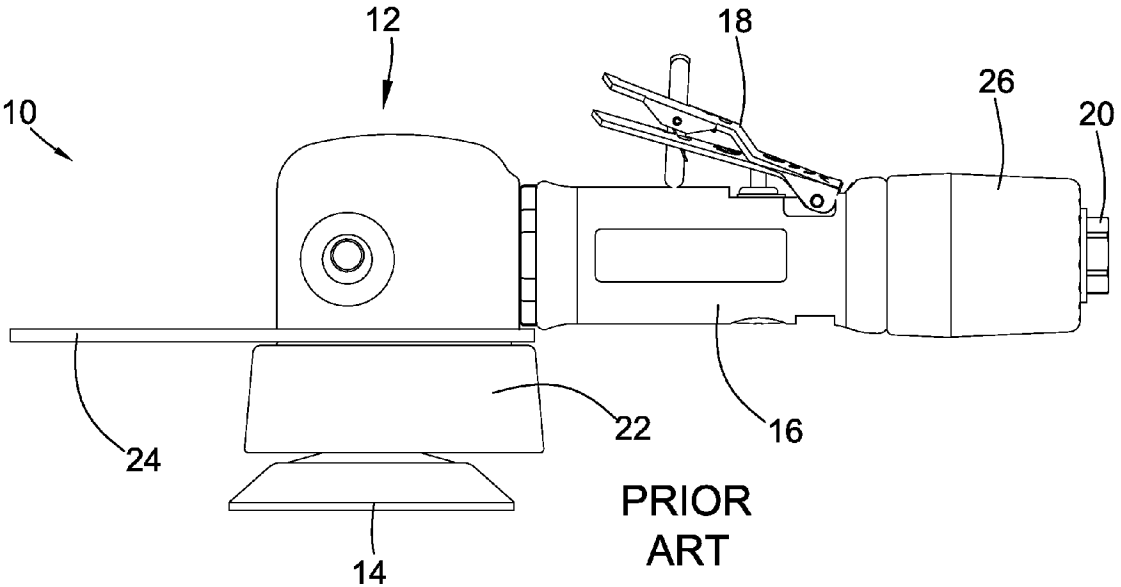
FIG. 1A is a side view of a prior art abrading tool.
Figure 1B:
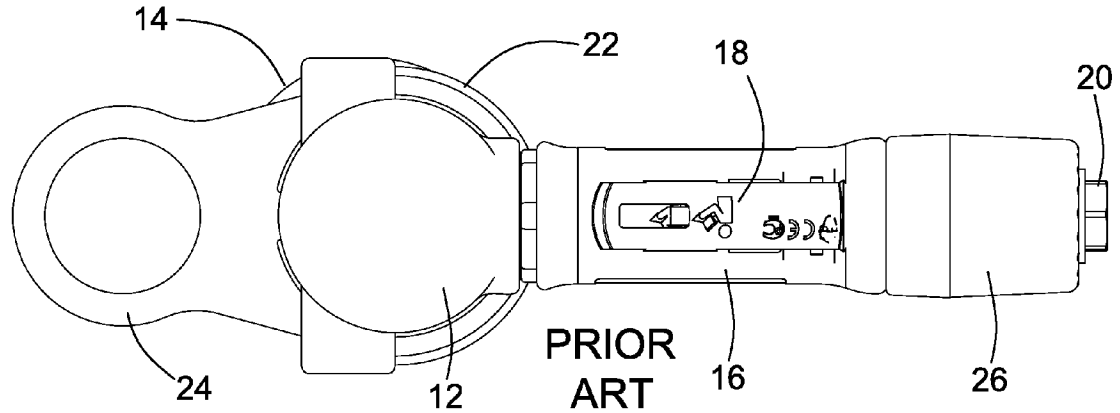
FIG. 1B is a top view of the prior art abrading tool shown in FIG. 1.

In the shown embodiment, drive assembly 104 is arranged to enable head 100 to be used for random orbital abrading. For example, drive assembly 104 could generally refer to any suitable drive means for an abrading device, such as taught in the aforementioned '771 or '085 patents, which describe random orbital abrading devices. In the preferred embodiment, drive assembly 104 is regulated by a valve mechanism in a handle portion of a tool. For example, head 100 could affix to any suitable handle known in the art. As a specific example, head 100 could replace head 12 as shown in FIGS. 1A and 1B, affixing to handle 16, and powered by a pneumatic source coupled to the buffer via inlet 20 and regulated via trigger mechanism 18 which controls the pneumatic input to the drive means. Advantageously, head 100 would not require rear muffler 26, as discussed below.

Figure 4:
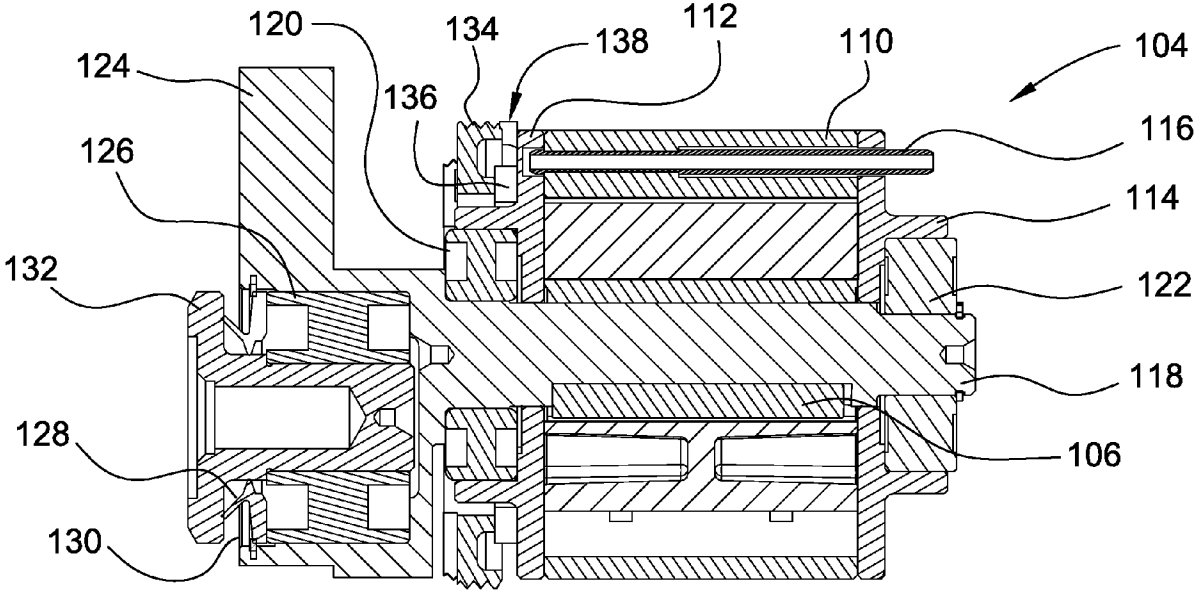
FIG. 4 is a cross-sectional view of a drive assembly shown in FIG. 3.
Figure 5:
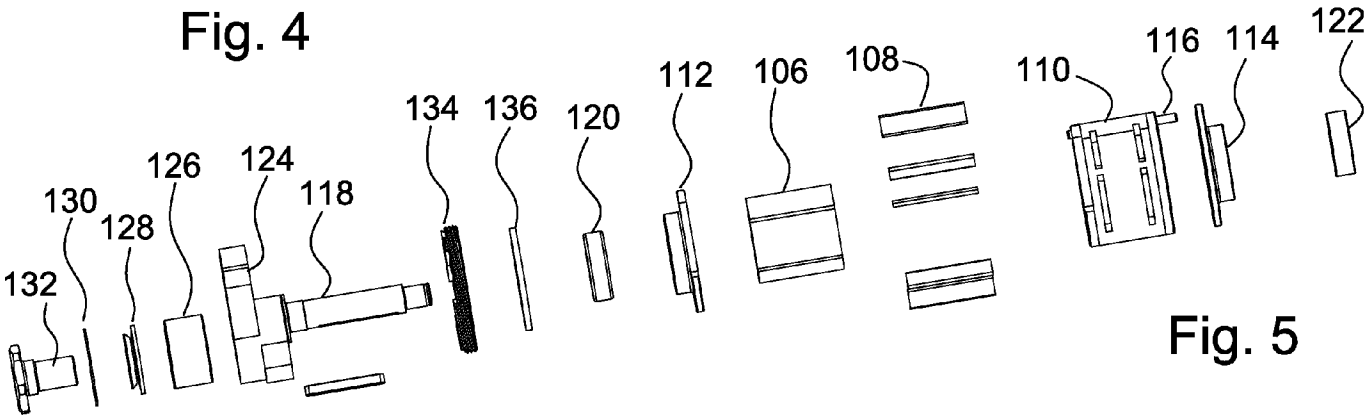
FIG. 5 is an exploded view of the drive assembly shown in FIG. 4.

One embodiment of drive assembly 104 is shown in FIGS. 4 and 5. In the shown embodiment, the drive assembly comprises rotor 106 having vanes 108. The rotor and vanes are housed within cylinder 110 between front and rear bearing plates 112 and 114, respectively. Pin 116 locks the front and rear bearing plates to cylinder 110. The rotor is rotatable about shaft 118, with shaft 118 engaged with bearings 120 and 122, which bearings sit in front and rear bearing plates 112 and 114, respectively. On one end of shaft 118 is counterbalance 124 for enabling random orbital movement, as described. Bearing 126 is sealed adjacent counterbalance 124 near the end of shaft 118 via v-ring 128 and snap ring 130. Shaft 132 engages in bearing 126, and is operatively arranged to connect to a buffer pad, such as buffer pad 105. Lock ring 134 is provided to secure the drive assembly in housing 102. Spacer 136 is included to create gap 138 between lock ring 134 and front bearing plate 112.

As shown generally in FIGS. 2 and 3, drive assembly 104 is locked into housing 102 via lock ring 134. In the shown embodiment, lock ring 134 threadingly engages with interior threading on housing 102 for locking drive assembly 104 in housing 102. A shroud is formed by inner and outer shroud portions 140 and 142, engaged with housing 102. The inner and outer shroud portions form a shroud chamber 141. The shroud generally surrounds counterbalance 124 and second shaft 132 near the end of shaft 118. Outer shroud portion 140 engages with o-ring 144 against lip 146 of housing 102, and inner shroud portion 142 engages with o-ring 148 against lip 150 of housing 102. It should be appreciated that the o-rings could be replaced by any other suitable sealing means known in the art for preventing leakage of the exhaust as it travels through head 100. A least one aperture 152 is included between lips 146 and 150. In the shown embodiment, aperture 152 is included in groove 154, between the lips. Groove 154 enables o-ring 144 to expand as the o-ring is moved into engagement with lip 146, without risk of damaging the o-ring. That is, if groove 154 were not formed between the lips, then a portion of o-ring 144 would likely expand into aperture 152 as the o-ring passes over the aperture, and this portion would like be clipped or sheared off as the o-ring is forced into final engagement with the housing. Since the o-rings prevent leakage of air as it is exhausted out the front of the buffer, it is important that the o-rings are not damaged during assembly.

Muffling material 156 is included between the inner and outer shroud portions. In one embodiment, the muffling material is a strip of felt. By including muffling material 156 in the gap formed between the inner and outer shroud portions, the shroud effectively acts as a muffler for the buffer. Previously, as discussed above, muffler were included at the far opposite end of the handle from the buffer head, and the handle accordingly required two sealed channels so that the handle could both receive the pneumatic input and expel the exhaust. Thus, if head 100 is utilized, a muffler is not required at the opposite end of the buffing tool. For example, muffler 26 would not be required in tool 10 if head 12 were replaced with head 100. Additionally, since only one chamber is required in the handle, the arrangement of the handle can be greatly simplified.

Figure 8:
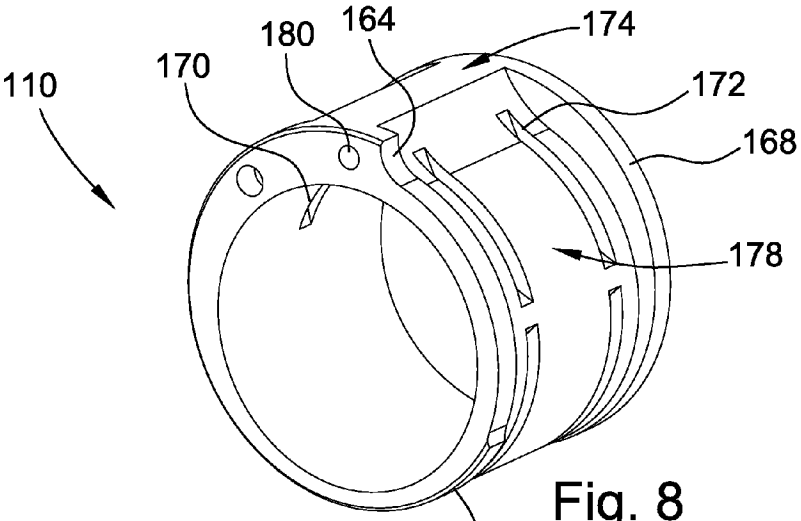
Figure 7:
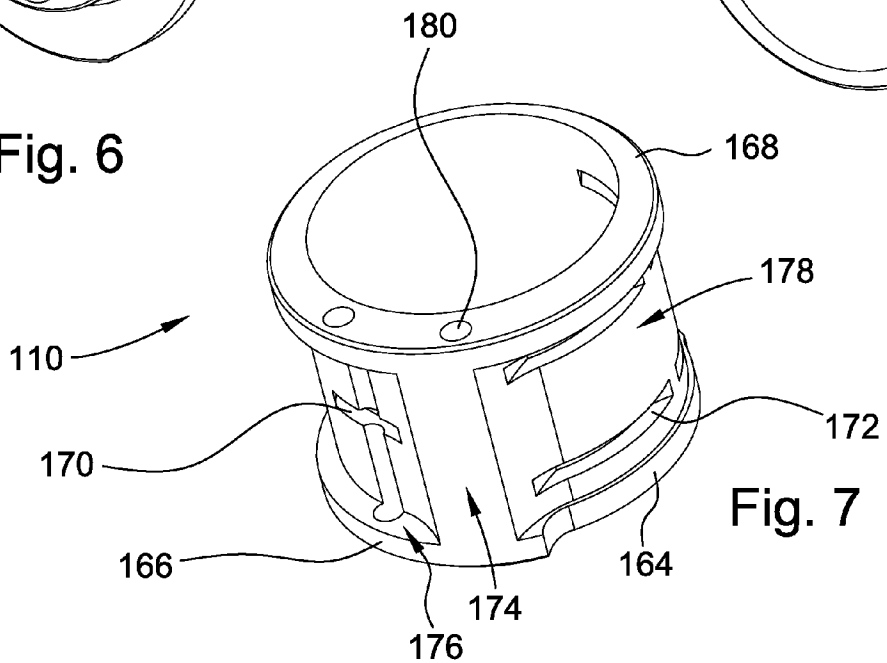
Figure 6:
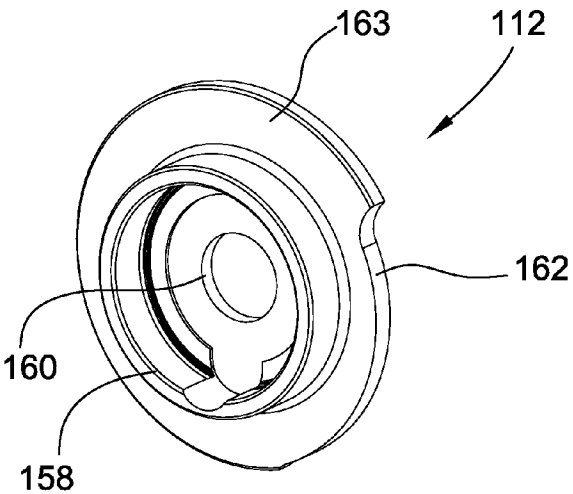
FIG. 6 is a perspective view of a front bearing plate of the drive assembly of FIGS. 4 and 5; and, FIGS. 7 and 8 are perspective views of a cylinder of the drive assembly of FIGS. 4 and 5.

Front bearing plate 112 is shown in more detail in FIG. 6. Plate 112 includes annular projection 158, in which bearing 120 is to be seated. Shaft 118 is insertable through bore 160 for rotatable engagement with bearing 120. Plate 112 also includes cut 162 in flange 163. Cylinder 110, shown in more detail in FIGS. 7 and 8, includes cut 164 which corresponds to cut 162 in front edge or rim 166. Conversely, the opposite rim, rear rim 168 provides a constant diameter about the cylinder and does not include a cut. During operation of a tool including head 100, a pneumatic input (e.g., pressurized air) is fed into drive assembly 104, which is housed within cylinder 110, via inlet 170. The air is exhausted through outlets 172. Dividing area 174 is at a common diameter with rear rim 168 and the uncut portion of front rim 166 for separating the inlet from the outlet (a similar dividing area is included on the opposite side of the Figures, hidden from view). That is, the housing preferably has an inner diameter which corresponds to the outer diameter of the cylinder for sealing the pneumatic input between rims 166 and 168 in recessed area 176 proximate inlet 170. The exhaust is expelled from outlets 172 into recessed area 178, which is bounded on one side by rim 168. Recessed area 178 generally defines an exhaust cavity between housing 102, the body of cylinder 110, and rim 168. The exhaust is free to exit the housing via cut 164 in front rim 166. Pin 116 is insertable through bore 180 for engagement with a corresponding bore in rear bearing plate 114, and partial bore in plate 112 (hidden from view in FIG. 4).

The assembly of head 100 can be best appreciated by referring again to FIGS. 2 and 3. Grip cover 103 engages over housing 102. Hang ring 107 clips onto the housing and is held in place due to lip 146. O-ring 144 seals outer portion 140 of the shroud against lip 146 of the housing. Muffling material 156 is engaged between outer portion 140 and inner portion 142 of the shroud. O-ring 148 seals inner portion 142 of the shroud against lip 150 of the housing, containing muffling material 156 in chamber 141 formed between the outer and inner portions of the shroud. Orifice 152 is included to provide pneumatic communication between cavity 178 and chamber 141 for enabling the exhaust to flow from the cavity to the chamber. Screws 182 secure inner shroud portion 142 to housing 102 via bores 184. In addition to friction between outer shroud portion 140 and housing 102, the outer shroud portion is also supported by projections 143 of inner shroud portion 142. Lock ring 134 is included to lock the top portion of drive assembly 104 within housing 102, with the bottom portion of the drive assembly surrounded by the shroud. Abrasive pad 105 secures to shaft 132, which is freely rotatable about a second axis, assisted by bearing 126.

Thus, it can be seen that a path can be traced throughout head 100 which enables the exhaust to be expelled directly on the abrasive pad. Specifically, air or some other operating fluid is supplied to head 100 via a port in a handle, such as port 20 in handle 16. The operating fluid then powers the rotor to rotate drive assembly 104 about shaft 118. The operating fluid is exhausted via outlets 172 into exhaust cavity 178 between cylinder 110 and the interior of housing 102. Cuts 162 and 164 enable the exhaust to flow out of exhaust cavity 178 and into shroud chamber 141. Specifically, in the shown embodiment, spacer 136 between lock ring 134 and plate 112 creates gap 138, which aligns with holes 152 in housing 102. Holes 152 align with outer and inner shroud portions 140 and 142 so that the exhaust enters shroud cavity 141. That is, the exhaust flows through the channel created by cuts 162 and 164 into gap 138, and from gap 138 through holes 152 into chamber 141. O-rings 144 and 148 seal above and below holes 152 to prevent leakage of the exhaust. The exhaust then exits shroud chamber 141 via holes 186 in the inner shroud portion or through slots 145 formed between projections 143 and the outer shroud portion.

Accordingly, the exhaust is directly vented onto the abrasive pad for improved cooling of the pad during operation. By directly, it is meant that the exhaust is contained in the head and must only travel through the head, and not back through the handle. Advantageously, this enables increased buffing speed and buffer pad lifespan, decreased buffing time and a reduced occurrence of imperfections caused on the buffing surface due to overheating of the pad. The shown arrangement also reduces the required complexity of a handle for a tool using head 100, since the exhaust no longer needs to travel back through the handle, eliminating the need for a rear muffler (e.g. muffler 26). Thus, the above described embodiment enables the shroud to not only protect and contain the rotating components of the drive assembly (counterbalance 124 particularly), but to also muffle the exhaust as it passes through the head to cool the buffing pad.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What I claim is:

1. A head for an orbital abrading machine comprising:

a housing;

a shroud including inner and outer portions, defining a chamber between said inner and outer portions;

a drive means for driving an abrading pad, said drive means at least partially enclosed by said housing and said shroud, wherein said drive means produces an exhaust which is directly vented into said chamber without leaving said head; and an exhaust cavity for receiving said exhaust from said drive means, said exhaust cavity in pneumatic communication with said chamber for enabling said exhaust to flow from said exhaust cavity and into said chamber, wherein:

said chamber includes at least one opening for directing said exhaust toward said abrading pad for cooling said pad with said exhaust;

said drive means comprises a pneumatically-powered rotor;

said inner and outer shroud portions are engaged against said housing about an orifice with a first seal and a second seal, respectively; and, said orifice provides said pneumatic communication between said exhaust cavity and said chamber, said first and second seals for preventing leakage of said exhaust as said exhaust flows from said exhaust cavity through said orifice into said chamber.

2. The head recited in claim 1, wherein said drive means receives a pneumatic input, said pneumatic input sealed from said exhaust except for a path through said drive means.

3. The head recited in claim 1, wherein muffling material is contained within said chamber for muffling said exhaust.

4. The head recited in claim 1, wherein said drive means is secured at least partially within said housing with a lock ring, wherein a spacer is provided with said lock ring for creating a gap, said gap enabling pneumatic communication between said exhaust cavity and said chamber.

5. An abrading tool comprising:

a head according to claim 1;

a handle secured to said head, said handle including a port for coupling said abrading tool to a source for powering said drive means.

6. The abrading tool recited in claim 5, wherein said abrading tool is pneumatically-powered.

7. The abrading tool recited in claim 6, wherein said abrading tool is a random orbital buffer.

8. The abrading tool recited in claim 6, wherein said chamber includes muffling material for enabling said shroud to muffle said exhaust.

9. A head for an orbital abrading machine comprising:

a housing;

a shroud including inner and outer portions, defining a chamber between said inner and outer portions;

a drive means for driving an abrading pad, said drive means at least partially enclosed by said housing and said shroud, wherein said drive means produces an exhaust which is directly vented into said chamber without leaving said head; and, an exhaust cavity for receiving said exhaust from said drive means, said exhaust cavity in pneumatic communication with said chamber for enabling said exhaust to flow from said exhaust cavity and into said chamber, wherein:

said chamber includes at least one opening for directing said exhaust toward said abrading pad for cooling said pad with said exhaust;

said drive means comprises a pneumatically-powered rotor; and, said drive means receives a pneumatic input, said pneumatic input sealed from said exhaust except for a path through said drive means.

10. A head for an orbital abrading machine comprising:

a housing;

a shroud including inner and outer portions, defining a chamber between said inner and outer portions;

a drive means for driving an abrading pad, said drive means at least partially enclosed by said housing and said shroud, wherein said drive means produces an exhaust which is directly vented into said chamber without leaving said head; and, an exhaust cavity for receiving said exhaust from said drive means, said exhaust cavity in pneumatic communication with said chamber for enabling said exhaust to flow from said exhaust cavity and into said chamber, wherein:

said chamber includes at least one opening for directing said exhaust toward said abrading pad for cooling said pad with said exhaust;

said drive means comprises a pneumatically-powered rotor;

said drive means is secured at least partially within said housing with a lock ring; and, a spacer is provided with said lock ring for creating a gap, said gap enabling pneumatic communication between said exhaust cavity and said chamber.

* * * * *